US007287970B2

(12) United States Patent
Hirano et al.

(10) Patent No.: US 7,287,970 B2
(45) Date of Patent: Oct. 30, 2007

(54) ROOTS COMPRESSOR

(75) Inventors: Takayuki Hirano, Kariya (JP); Kazuho Yamada, Kariya (JP); Toshiro Fujii, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 85 days.

(21) Appl. No.: 11/259,871

(22) Filed: Oct. 26, 2005

(65) Prior Publication Data

US 2006/0088427 A1 Apr. 27, 2006

(30) Foreign Application Priority Data

Oct. 27, 2004 (JP) ..... 2004-312782

(51) Int. Cl.
*F04C 2/18* (2006.01)
*F04C 29/00* (2006.01)

(52) U.S. Cl. ..... 418/178; 418/140; 418/206.1

(58) Field of Classification Search ..... 418/206.1, 418/206.6, 139, 140, 143, 153, 178
See application file for complete search history.

(56) References Cited

U.S. PATENT DOCUMENTS

| | | | | |
|---|---|---|---|---|
| 4,744,738 | A * | 5/1988 | Miki et al. | 418/126 |
| 5,554,020 | A * | 9/1996 | Rao et al. | 418/178 |
| 6,206,668 | B1 * | 3/2001 | Teraoka et al. | 418/206.4 |
| 2004/0265146 | A1 * | 12/2004 | Kagami et al. | 417/410.3 |
| 2005/0089414 | A1 * | 4/2005 | Ohman | 417/410.4 |

FOREIGN PATENT DOCUMENTS

| | | |
|---|---|---|
| JP | 63-83479 | 4/1988 |
| JP | 5-231362 | 9/1993 |
| JP | 6-229248 | 8/1994 |
| JP | 10-220371 | 8/1998 |
| JP | 10-299676 | 11/1998 |
| JP | 2002-213381 | 7/2002 |

OTHER PUBLICATIONS

Derwent Publication No. 2001-387195, Date: May 2001, Derwent publication is of Japanese Patent Publication No. JP 2001-123974 A, Assignee: Asahi Glass Co. Ltd.*

* cited by examiner

*Primary Examiner*—Thomas Denion
*Assistant Examiner*—Mary A Davis
(74) *Attorney, Agent, or Firm*—Morgan & Finnegan, L.L.P.

(57) ABSTRACT

A roots compressor has a housing, a rotary shaft, a rotor and a layer. The housing defines a pump chamber, a suction port and a discharge port. The suction port and the discharge port adjoin to the pump chamber. The rotary shaft is rotatably supported by the housing. The rotor is connected to the rotary shaft and contained in the pump chamber. Fluid introduced into the pump chamber through the suction port is discharged to the outside of the pump chamber through the discharge port by rotation of the rotor which is driven through the rotary shaft. The layer is formed on an inner peripheral surface of the housing, which defines the pump chamber. The layer is thinner from a side adjacent to the suction port toward a side adjacent to the discharge port in circumferential direction of the housing.

11 Claims, 5 Drawing Sheets

ROOTS COMPRESSOR

TECHNICAL FIELD

The present invention relates to a roots compressor that discharges fluid introduced into its pump chamber to the outside of the pump chamber by the rotation of its rotor.

In a fuel cell system which generates electricity by reacting hydrogen with oxygen, oxygen is in general supplied to the fuel cell with a roots compressor. The roots compressor includes a housing which defines therein a pump chamber and further includes a drive rotor and a driven rotor which are fixed to a rotary shaft of the compressor and contained in the housing.

Japanese unexamined patent publication No. 6-229248 discloses such a roots compressor that the inner peripheral surface of the housing of the compressor is coated with a resin layer for preventing each rotor from directly sliding on the inner surface of the housing which defines a pump chamber. This roots compressor has an appropriate clearance between the resin layer and each rotor for reducing air leakage from the side adjacent to the discharge port (high-pressure side) to the side adjacent to the suction port (low-pressure side) while preventing the interference between each rotor and the resin layer. This clearance and the thickness of the resin layer are uniform over the housing in circumferential direction at the ordinary temperature of the roots compressor. Furthermore, the roots compressor disclosed in the Japanese unexamined patent publication No. 6-229248 is designed to be operable to cool the housing and the resin layer by refrigerant that flows through a refrigerant passage in the housing.

Then, in the roots compressor disclosed in the publication No. 6-229248, as the drive rotor is rotated by a driving source such as a motor, the driven rotor is also rotated following the drive rotor, thereby air is introduced into the pump chamber through a suction port formed adjoining to the pump chamber. Moreover, the air is compressed by the rotation of the drive and driven rotors and discharged to the outside of the pump chamber through the discharge port formed adjoining to the pump chamber. In this compression process, air is compressed in the pump chamber and thereby increases in temperature, with the result that the heat is conducted from the air to each rotor, the resin layer and the housing receive. Since the housing is cooled by refrigerant flowing through the refrigerant passage, the housing and the resin layer via the housing are kept at a low temperature. Accordingly, the resin layer substantially does not expand and its thickness is kept uniform over the entire circumferential direction of the housing.

In the roots compressor of the publication No. 6-229248, the resin layer increases in temperature because the heat of air is directly conducted to the resin layer. At this time, the resin layer adjacent to the discharge port where the compression ratio of air is relatively high is higher in temperature than the resin layer adjacent to the suction port. That is, there occurs a temperature difference between the resin layer adjacent to the discharge port and the resin layer adjacent to the suction port. As a result, the resin layer adjacent to the discharge port has a larger expansion in through-thickness direction than that adjacent to the suction port. Thus, the resin layer adjacent to the discharge port is thicker than that adjacent to the suction port. Therefore, there will be a large difference in thickness between the resin layer adjacent to the discharge port and the resin layer adjacent to the suction port during operation of the roots compressor. That is, there will be a large difference in clearance between the side adjacent to the discharge port and the side adjacent to the suction port during operation of the roots compressor. Thus, the air leakage from the side adjacent to the discharge port to the side adjacent to the suction port through the clearance increases, with the result that the compression ratio largely decreases or trouble such as an increase in drive power due to the leakage occurs.

The present invention is directed to providing a roots compressor that can reduce a difference in clearance between the side adjacent to the discharge port and the side adjacent to the suction port during operation of the compressor.

SUMMARY

In accordance with the present invention, a roots compressor has a housing, a rotary shaft, a rotor and a layer. The housing defines a pump chamber, a suction port and a discharge port. The suction port and the discharge port adjoin to the pump chamber. The rotary shaft is rotatably supported by the housing. The rotor is connected to the rotary shaft and contained in the pump chamber. Fluid introduced into the pump chamber through the suction port is discharged to the outside of the pump chamber through the discharge port by rotation of the rotor which is driven through the rotary shaft. The layer is formed on an inner peripheral surface of the housing, which defines the pump chamber. The layer is thinner from a side adjacent to the suction port toward a side adjacent to the discharge port in circumferential direction of the housing.

In accordance with the present invention, a roots compressor has a housing, a rotary shaft, a rotor and a layer. The housing defines a pump chamber, a suction port and a discharge port. The suction port and the discharge port adjoin to the pump chamber. The rotary shaft is rotatably supported by the housing. The rotor is connected to the rotary shaft and contained in the pump chamber. Fluid introduced into the pump chamber through the suction port is discharged to the outside of the pump chamber through the discharge port by rotation of the rotor which is driven through the rotary shaft. The layer is formed on an inner peripheral surface of the housing, which defines the pump chamber. The layer is uniform from a side adjacent to the suction port toward a side adjacent to the discharge port in circumferential direction of the housing. The layer and the rotor define therebetween a clearance, which is narrower from a side adjacent to the suction port toward a side adjacent to the discharge port in the circumferential direction.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

The following will describe a preferred embodiment of a roots compressor for supplying oxygen to a fuel cell system according to the present invention with reference to FIGS. 1 through 7.

Figure 1:
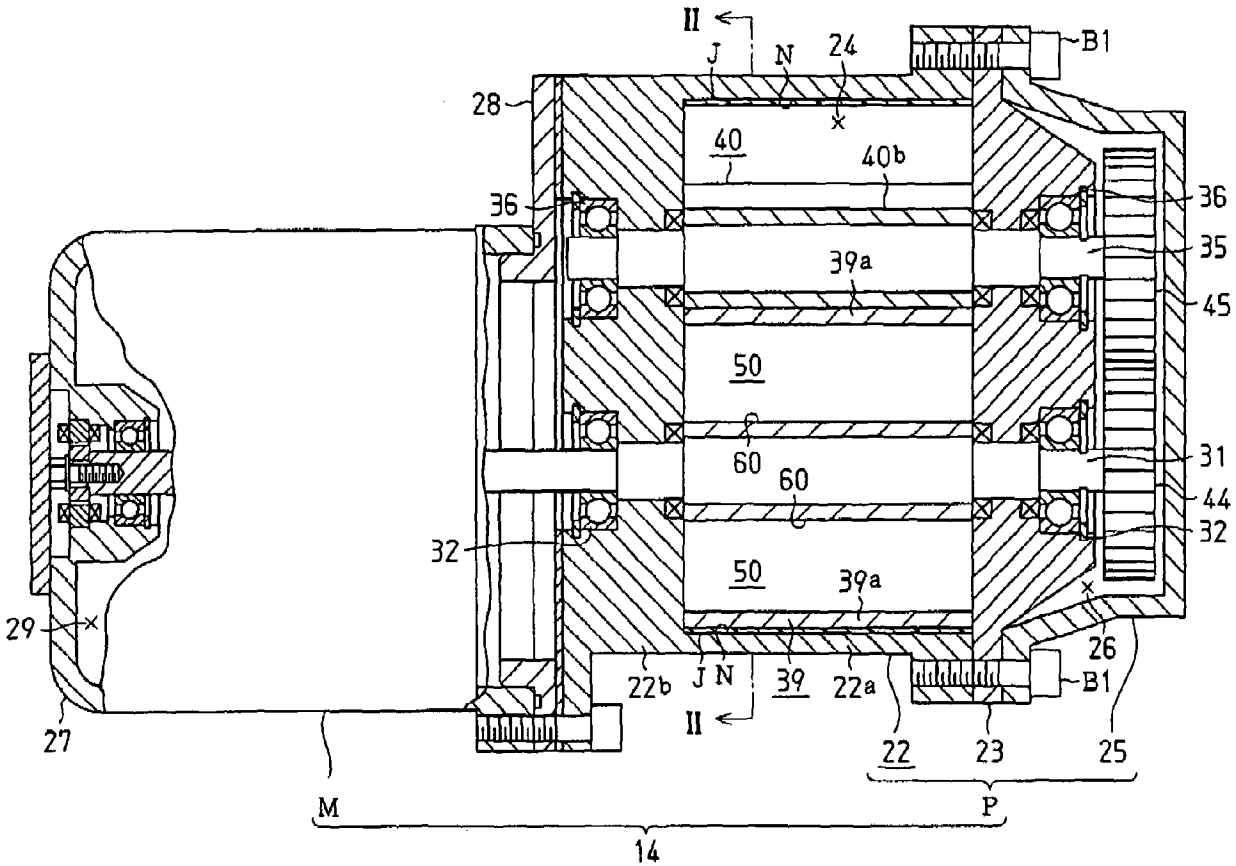
FIG. 1 is a cross-sectional view of a roots compressor according to a preferred embodiment of the present invention.

The roots compressor 14 will now be described. As shown in FIG. 1, the roots compressor 14 according to the preferred embodiment has a pump part P and a motor part M. The pump part P includes a rotor housing 22, a shaft support member 23 connected to the rear end (the right end in FIG. 1) of the rotor housing 22 and a gear housing 25 connected to the rear surface (the right surface in FIG. 1) of the shaft support member 23. In the pump part P, a pump chamber 24 is defined between the rotor housing 22 and the shaft support member 23, and a gear chamber 26 is defined between the gear housing 25 and the shaft support member 23. The motor part M includes a motor housing 27 connected to the front end (the left end in FIG. 1) of the rotor housing 22 through a partition wall 28. A motor chamber 29 is defined between the partition wall 28 and the motor housing 27, and an electric motor (not shown) is contained in the motor chamber 29.

In the roots compressor 14, a drive shaft 31 is rotatably supported by the motor housing 27, the rotor housing 22 and the shaft support member 23 through bearings 32. Furthermore, a driven shaft 35, which is in parallel relation to the drive shaft 31, is rotatably supported by the rotor housing 22 and the shaft support member 23 through bearings 36. The drive shaft 31 and the driven shaft 35 correspond to a rotary shaft in this embodiment.

Figure 2:
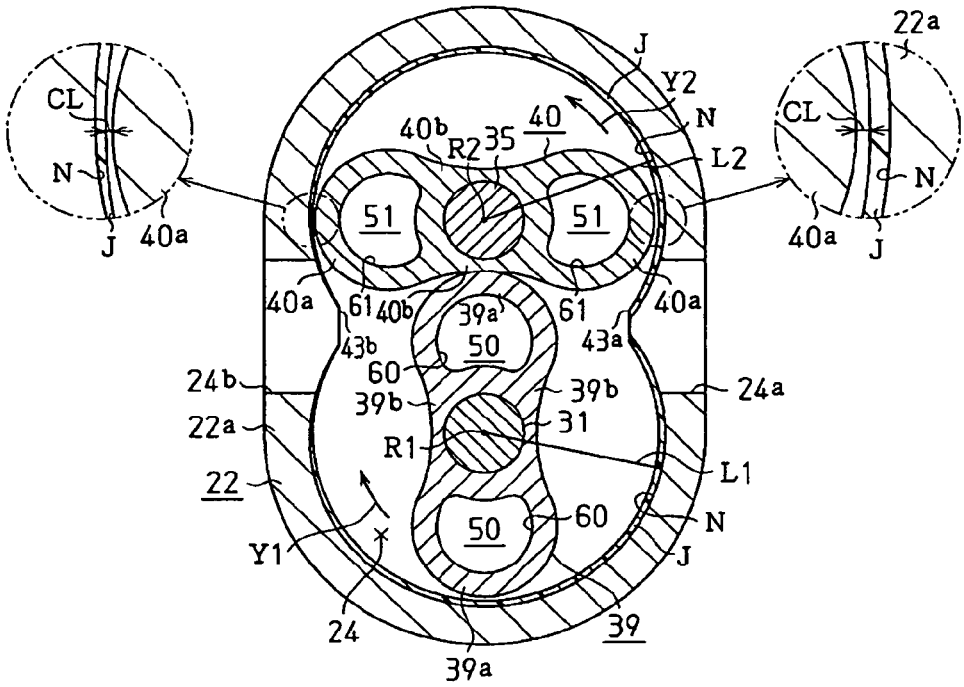
FIG. 2 is a cross-sectional view that is taken along the line II-II in FIG. 1.

As shown in FIGS. 1 and 2, in the pump chamber 24, a drive rotor 39 is fixed to the drive shaft 31, and a driven rotor 40 is fixed to the driven shaft 35. The drive rotor 39 and the driven rotor 40 each are bibbed or gourd-shaped in cross-section that is taken perpendicularly to the axial direction of the drive shaft 31 and the driven shaft 35. The drive rotor 39 includes two external teeth 39*a* and two internal teeth 39*b* formed between the external teeth 39*a*. Similarly, the driven rotor 40 includes two external teeth 40*a* and two internal teeth 40*b* formed between the external teeth 40*a*.

The external teeth 39*a* of the drive rotor 39 engages with the internal teeth 40*b* of the driven rotor 40, and the external teeth 40*a* of the driven rotor 40 engages with the internal teeth 39*b* of the drive rotor 39. The drive rotor 39 has through holes 60 adjacent to both the external teeth 39*a*, the through holes 60 each extending axially through the drive rotor 39. Similarly, the driven rotor 40 has through holes 61 adjacent to both the external teeth 40*a*, the through holes 61 extending axially through the driven rotor 40. The through holes 60, 61 each have substantially a semi-circular shape in cross-section that is taken perpendicularly to the axial direction of the drive rotor 39 and the driven rotor 40, respectively. The rotors 39, 40, provided with these through holes 60, 61, form hollow rotors having hollows 50, 51, respectively.

In the pump chamber 24, a suction port 24*a* is formed adjoining to the rotor housing 22 for introducing air into the pump chamber 24, as shown in FIG. 2. In addition, in the pump chamber 24, a discharge port 24*b* is formed adjoining to the rotor housing 22 on the opposite side to the suction port 24*a*, as shown in FIG. 2. The discharge port 24*b* is formed to discharge air, which is compressed in the pump chamber 24 by the rotation of the drive rotor 39 and the driven rotor 40, from the pump chamber 24. In the gear chamber 26, a drive gear 44 fixed to the rear end of the drive shaft 31 is in engagement with a driven gear 45 fixed to the rear end of the driven shaft 35, as shown in FIG. 1.

In the above roots compressor 14, as the drive shaft 31 is rotated by the rotation of the electric motor, the driven shaft 35 is rotated in the opposite direction to the rotating direction of the drive shaft 31 through the engagement between the drive gear 44 and the driven gear 45. As a result, in the pump chamber 24, the drive rotor 39 and the driven rotor 40 are synchronously rotated with a difference in phase of 90 degrees between the drive shaft 31 and the driven shaft 35. In accordance with the synchronous rotation of the drive rotor 39 and the driven rotor 40, air is introduced into the pump chamber 24 through the suction port 24*a*. After that, the air introduced into the pump chamber 24 is compressed by the cooperation of the outer surfaces of the drive and driven rotors 39, 40 and the inner surface of the pump chamber 24. Due to the rotation of the drive rotor 39 and the driven rotor 40, the compressed air is discharged to the outside of the pump chamber 24 through the discharge port 24*b*.

The following will describe the pump chamber 24. It is noted that the pump chamber 24 of the roots compressor 14 at the ordinary temperature (approximately 25 degrees C.) will be described. The pump chamber 24 is defined by the rotor housing 22 and the shaft support member 23, and the inner peripheral surface N of the rotor housing 22 is coated with a resin layer J. Specifically, the rotor housing 22 includes a cylindrical peripheral wall 22*a* and a front wall 22*b* on the front end of the peripheral wall 22*a*. The pump chamber 24 is defined by the peripheral wall 22*a*, the front wall 22*b* and the shaft support member 23. The pump chamber 24 has a shape that substantially traces the revolution loca of the external teeth 39*a*, 40*a* so as to rotatably contain the drive rotor 39 and the driven rotor 40. Then, in the pump chamber 24, the inner peripheral surface N of the peripheral wall 22*a*, which is the inner peripheral surface of the rotor housing 22, is bibbed or gourd-shaped in cross-section that is taken perpendicularly to the axial direction of the drive shaft 31 and the driven shaft 35.

As shown in FIG. 2, the peripheral wall 22*a* has protrusions 43*a*, 43*b* extending in axial direction of the drive shaft 31 and the driven shaft 35 at the positions where two revolution loca of the external teeth 39*a*, 40*a* intersect with each other. The protrusions 43*a*, 43*b* are built up toward the center of the pump chamber 24. The protrusions 43*a*, 43*b* are formed opposite to each other. The peripheral wall 22*a* has the suction port 24*a* that extends through the protrusion 43*a* and the discharge port 24*b* that extends through the protrusion 43*b*.

With respect to the drive rotor 39 of the pump chamber 24, the distance in radial direction between the rotation center R1 of the drive shaft 31 and the inner peripheral surface N is defined as L1. With respect to the driven rotor 40, the distance in radial direction between the rotation center R2 of the driven shaft 35 and the inner peripheral surface N is defined as L2. The distance L1 is gradually reduced from the side adjacent to the suction port 24*a* toward the side adjacent to the discharge port 24*b* in rotating direction Y1 (clockwise direction in FIG. 2) of the drive rotor 39. The distance L2 is gradually reduced from the side adjacent to the suction port 24*a* toward the side adjacent to the discharge port 24*b* in rotating direction Y2 (counter-clockwise direction in FIG. 2) of the driven rotor 40. As a result, each rotation center R1, R2 does not agree with the center of circular arc of the inner peripheral surface N where each rotor 39, 40 is contained and offset a little from the center of the circular arc. Each distance L1, L2 is longest at the opening edge of the suction port 24*a* and is shortest at the opening edge of the discharge port 24*b*.

The inner peripheral surface N of the peripheral wall 22*a* forming the pump chamber 24 is coated with the resin layer J. The resin layer J is formed over the entire inner peripheral surface N of the peripheral wall 22*a*. This resin layer J is made of ethylene-tetrafluoroethylene (ETFE) copolymer resin. Materials having a great coefficient of linear expansion, that is, materials to expand largely in thickness for a slight increase in temperature, are preferably used for the resin layer J.

Figure 3:
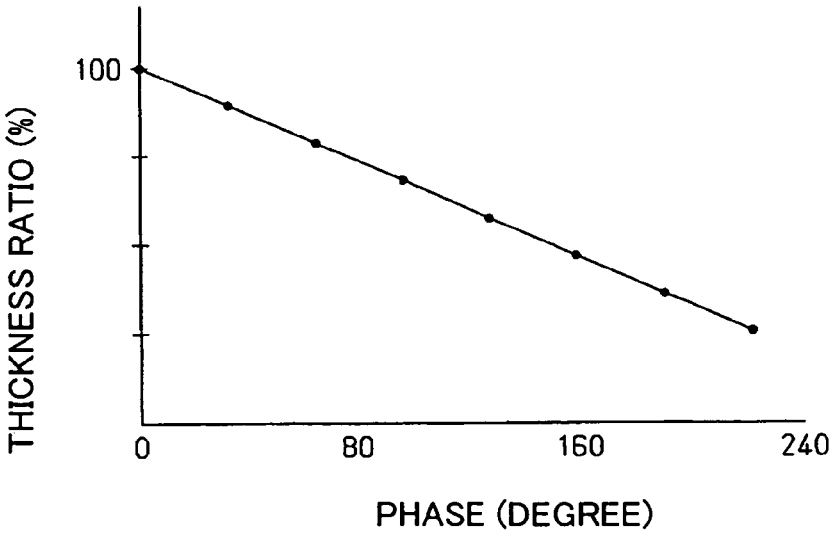
FIG. 3 is a graph showing a variation in ratio of thickness of a resin layer.

FIG. 3 is a graph showing a variation in thickness ratio of the resin layer J at the ordinary temperature of the roots compressor 14. In the graph of FIG. 3, the abscissa axis indicates a phase (degree), and the ordinate axis indicates a thickness ratio (percent). The phase (degree) indicates a position on the inner peripheral surface N of the peripheral wall 22*a*. That is, the position of the opening end of the suction port 24*a* on the inner peripheral surface N of the peripheral wall 22*a* is defined as a phase of zero degrees, the phase increases toward the side adjacent to the discharge port 24*b* in circumferential direction of the peripheral wall 22*a*, and the position of the opening end of the discharge port 24*b* is defined as a phase of 240 degrees. On the other hand, the thickness ratio (percent) indicates the ratio of thickness of the resin layer J at a phase relative to the thickness of the resin layer J at a phase of zero degrees (the thickness of the resin layer J at a phase/the thickness of the resin layer J at a phase of zero degrees×100). Accordingly, the thickness ratio is 100% at a phase of zero degrees. As shown in FIG. 3, the thickness ratio of the resin layer J is proportionally lowered from the side adjacent to the suction port 24*a* (a phase of zero degrees) toward the side adjacent to the discharge port 24*b* (a phase of 240 degrees) in circumferential direction of the peripheral wall 22*a*, that is, in accordance with an increase in phase. That is, the resin layer J is reduced in thickness from the side adjacent to the suction port 24*a* (a phase of zero degrees) toward the side adjacent to the discharge port 24*b* (a phase of 240 degrees) in circumferential direction of the peripheral wall 22*a*.

The resin layer J has a highest thickness ratio at a phase of zero degrees and, therefore, the thickness is maximal. Then, the resin layer J gradually varies in thickness ratio (or thickness) from the side adjacent to the suction port 24*a* toward the side adjacent to the discharge port 24*b* in circumferential direction of the peripheral wall 22*a*. The thickness ratio is lowest at a phase of 240 degrees and, therefore, the thickness is minimal. The thickness (thickness ratio) of the resin layer J is not stepwise reduced (lowered) in circumferential direction but steplessly reduced. It is noted that the thickness of the resin layer J is determined to meet the service condition based upon the requirements of the roots compressor 14 such as environment and operation frequency, the material of the rotors 39, 40, the material of the rotor housing 22, and the like.

Figure 4:
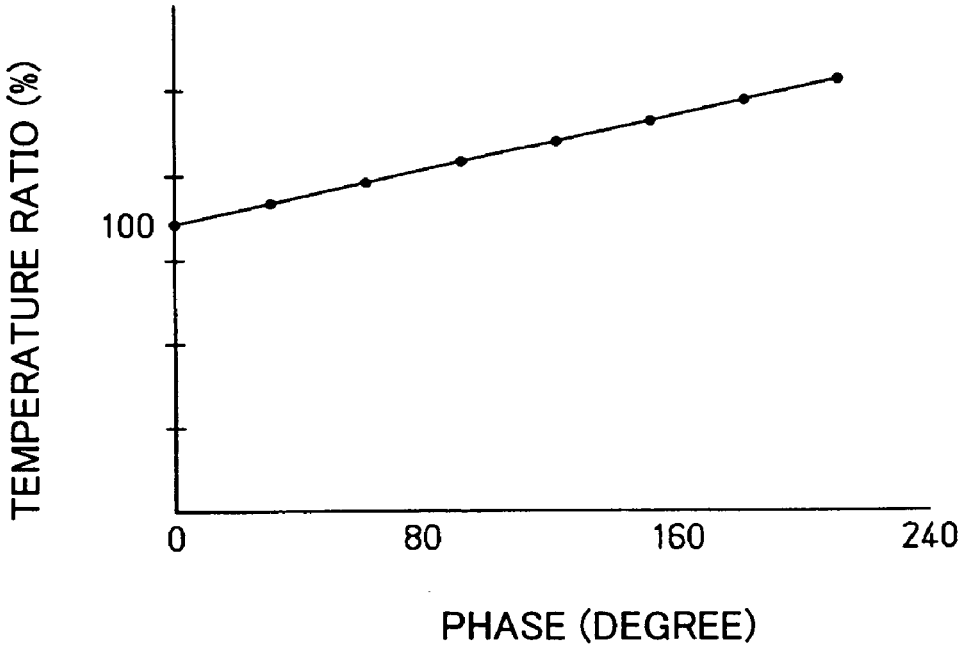
FIG. 4 is a graph showing a variation in ratio of temperature of a peripheral wall.

FIG. 4 is a graph showing the temperature ratio of the peripheral wall 22*a* during operation of the roots compressor 14. In the graph of FIG. 4, the abscissa axis indicates a phase (degree), and the ordinate axis indicates a temperature ratio (percent). The temperature ratio (percent) indicates a ratio of temperature of the peripheral wall 22*a* at a phase relative to a temperature of the peripheral wall 22*a* at a phase of zero degrees (a temperature of the peripheral wall 22*a* at a phase/a temperature of the peripheral wall 22*a* at a phase of zero degrees ×100). Accordingly, the temperature ratio is 100 percent at a phase of zero degrees. As shown in FIG. 4, the temperature ratio of the peripheral wall 22*a* is minimal at the opening end of the suction port 24*a* where a phase is zero degrees and is maximal at the opening end of the discharge port 24*b* where a phase is 240 degrees. The temperature ratio of the peripheral wall 22*a* is proportionally heightened from the side adjacent to the suction port 24*a* (a phase of zero degrees) toward the side adjacent to the discharge port 24*b* (a phase of 240 degrees) in circumferential direction of the peripheral wall 22*a*, that is, in accordance with an increase in phase. That is, the peripheral wall 22*a* increases in temperature from the side adjacent to the suction port 24*a* (a phase of zero degrees) toward the side adjacent to the discharge port 24*b* (a phase of 240degrees) in circumferential direction of the peripheral wall 22*a*. Then, the resin layer J has a higher (thicker) thickness ratio (thickness) at the side adjacent to the suction port 24*a* where the temperature ratio is relatively low and the expansion of the resin layer J is relatively small during operation of the roots compressor 14. On the other hand, the resin layer J has a lower (thinner) thickness ratio (thickness) at the side adjacent to the discharge port 24*b* where the temperature ratio is relatively high and the expansion is relatively large during operation of the roots compressor 14.

Figure 7:
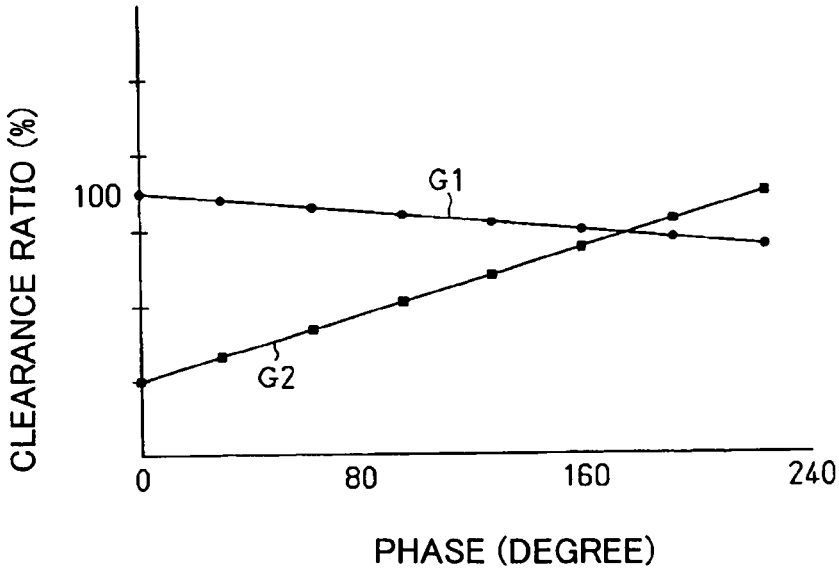
FIG. 7 is a graph showing a variation in ratio of clearance.

It is noted that the gap between the vertexes of the external teeth 39*a*, 40*a* of the drive rotor 39 and the driven rotor 40 and the resin layer J in radial direction of the drive shaft 31 and the driven shaft 35 is defined as a clearance CL. FIG. 7 is a graph G1 showing a variation in clearance ratio at the ordinary temperature of the roots compressor 14. In FIG. 7, the abscissa axis indicates a phase (degree), and the ordinate axis indicates a clearance ratio (percent). The clearance ratio (percent) indicates a ratio of clearance CL at a phase relative to a ratio of clearance CL at a phase of zero degrees (a clearance CL at a phase/a clearance CL at a phase of zero degrees×100). Accordingly, the clearance ratio is 100 percent at a phase of zero degrees.

Then, the distance L1, L2 is maximal at the opening end of the suction port 24*a* where a phase is zero degrees and is minimal at the opening end of the discharge port 24*b* where a phase is 240 degrees. In the resin layer J, the thickness (thickness ratio) is maximal at the opening end of the suction port at a phase of zero degrees and is minimal at the opening end of the discharge port 24*b* at a phase of 240 degrees. Accordingly, as shown in the graph G1 of FIG. 7, the clearance ratio is maximal at the opening end of the suction port 24*a* at a phase of zero degrees and is minimal at the opening end of the discharge port 24*b* at a phase of 240 degrees. The clearance ratio is proportionally lowered from the side adjacent to the suction port 24*a* (a phase of zero degrees) toward the side adjacent to the discharge port 24*b* (a phase of 240 degrees) in circumferential direction of the peripheral wall 22*a*, that is, in accordance with an increase in phase. That is, the clearance CL is narrowed from the side adjacent to the suction port 24*a* (a phase of zero degrees)

toward the side adjacent to the discharge port 24*b* (a phase of 240 degrees) in circumferential direction of the peripheral wall 22*a*. It is noted that the difference in clearance CL between the side adjacent to the suction port 24*a* and the side adjacent to the discharge port 24*b* is small, so that the air leakage from the side adjacent to the discharge port 24*b* to the side adjacent to the suction port 24*a* resulting from the difference in clearance CL is prevented.

The following will describe the operation of the roots compressor 14 for supplying air to the fuel cell system 10. It is noted that the roots compressor 14 has a temperature higher than the ordinary temperature (25 degrees C.) during operation of the roots compressor 14. The graph G2 in FIG. 7 shows a clearance ratio (percent) during operation of the roots compressor 14. The clearance ratio (percent) shows a ratio of clearance CL at a phase relative to a clearance CL at a phase of zero degrees.

Figure 5:
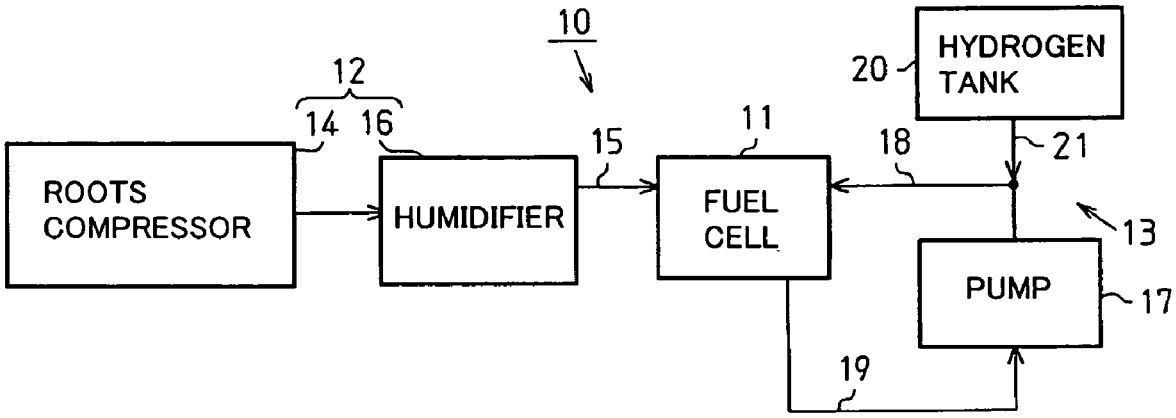
FIG. 5 is a block diagram of a fuel cell system.

The fuel cell system 10 includes a fuel cell 11, an oxygen supply means 12 and a hydrogen supply means 13, as shown in FIG. 5. The fuel cell 11 reacts oxygen (air) supplied from the oxygen supply means 12 with hydrogen supplied from the hydrogen supply means 13 to generate direct current electric energy (direct current electric power). The oxygen supply means 12 includes the roots compressor 14 for supplying compressed air, which is connected to an oxygen supply port (not shown) through a conduit 15. The conduit 15 is provided midway with a humidifier 16. The hydrogen supply means 13 includes a pump 17 for recycling hydrogen gas (hydrogen offgas) and a hydrogen tank 20, or a hydrogen supply. The pump 17 is connected to a hydrogen supply port (not shown) of the fuel cell 11 through a conduit 18 and connected to a hydrogen bleed port (not shown) of the fuel cell 11 through a conduit 19. The hydrogen tank 20 is connected to the conduit 18 through a conduit 21.

When the fuel cell system 10 generates electricity and the roots compressor 14 is operating, air is introduced into the pump chamber 24 through the suction port 24*a*, compressed by the drive rotor 39 and the driven rotor 40 and discharged through the discharge port 24*b*. When the roots compressor 14 is at the ordinary temperature, the difference in clearance CL (clearance ratio) between the side adjacent to the suction port 24*a* and the side adjacent to the discharge port 24*b* is small, with the result that the air leakage from the side adjacent to the discharge port 24*b* to the side adjacent to the suction port 24*a* due to the difference in clearance CL is suppressed to the minimum, as shown in the graph G1 of FIG. 7. Thus, air is compressed without a decrease in compression ratio.

Then, the air introduced into the pump chamber 24 through the suction port 24*a* is gradually compressed as it is transferred from the side adjacent to the suction port 24*a* toward the side adjacent to the discharge port 24*b*. In accordance with the compression, the air is gradually increased in temperature. Therefore, heat of the air in an increased temperature causes the resin layer J and the peripheral wall 22*a* to be increased in temperature. Then, since air in the ordinary temperature is introduced into the side adjacent to the suction port 24*a* of the pump chamber 24 through the suction port 24*a*, the resin layer J and the peripheral wall 22*a* are not increased a lot in temperature due to cooling by circulating air. On the other hand, the side adjacent to the discharge port 24*b* is increased in temperature. As a result, there occurs a difference in temperature (temperature ratio) between the peripheral wall 22*a* adjacent to the suction port 24*a* and the peripheral wall 22*a* adjacent to the discharge port 24*b*. In addition, the drive rotor 39 and the driven rotor 40 are rotated, so that they thermally expand uniformly as a whole.

Figure 6:
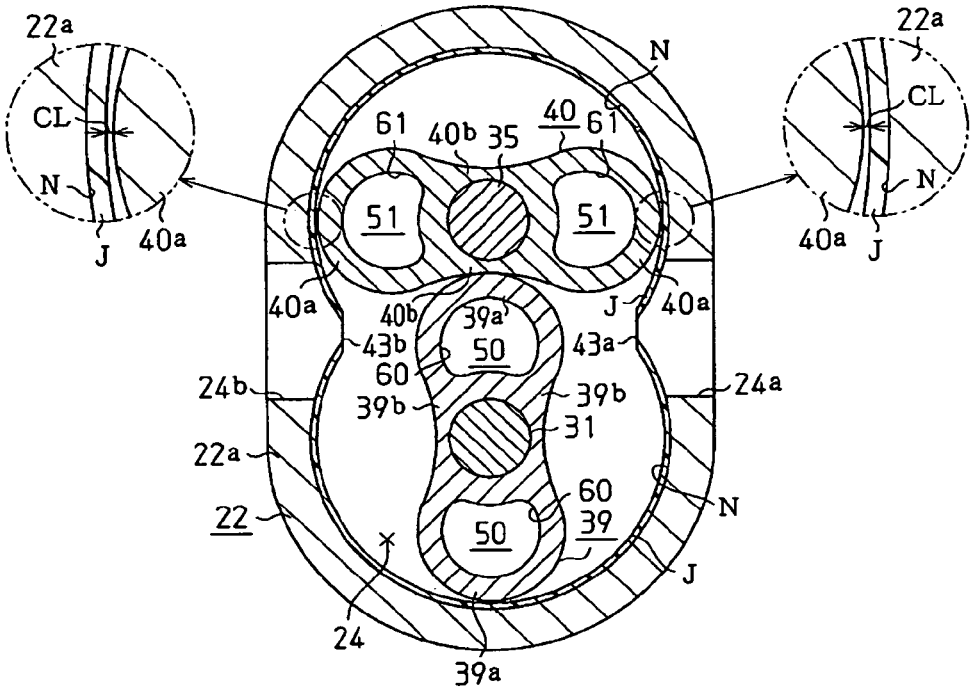
FIG. 6 is a cross-sectional view showing the inside of a pump chamber after thermal expansion.

As a result, as shown in FIG. 6, the side adjacent to the discharge port 24*b* of the resin layer J is higher in temperature than the side adjacent to the suction port 24*a*, so that it has a larger expansion in through-thickness direction. On the other hand, the side adjacent to the suction port 24*a* of the resin layer J is lower in temperature than the side adjacent to the discharge port 24*b*, so that it has a smaller expansion in through-thickness direction.

As shown in FIG. 3, the thickness (a ratio of thickness) of the resin layer J at the ordinary temperature of the roots compressor 14 is gradually reduced from the suction port 24*a* toward the discharge port 24*b* in circumferential direction. The opening end of the suction port 24*a* is maximal in thickness, and the opening end of the discharge port 24*b* is minimal in thickness.

Therefore, since the side adjacent to the discharge port 24*b* is higher in temperature than the side adjacent to the suction port 24*a*, the side adjacent to the discharge port 24*b* becomes thicker than that at the ordinary temperature but the initial thickness at coating is relatively thin, with the result that the thickness of the side adjacent to the discharge port 24*b* will not be too thick as a whole. On the other hand, since the side adjacent to the suction port 24*a* is lower in temperature than the side adjacent to the discharge port 24*b*, the side adjacent to the suction port 24*a* becomes thicker than that at the ordinary temperature but the initial thickness at coating is relatively thick, with the result that the thickness of the side adjacent to the suction port 24*a* will be appropriate as a whole. Accordingly, even if a difference in thermal expansion between the side adjacent to the suction port 24*a* of the peripheral wall 22*a* and the side adjacent to the discharge port 24*b* of the peripheral wall 22*a* occurs, the initial difference in thickness between the side adjacent to the suction port 24*a* and the side adjacent to the discharge port 24*b* evens the difference in thermal expansion of the resin layer J. That is, the thickness of the resin layer J is substantially uniform as a whole.

The side adjacent to the discharge port 24*b* of the peripheral wall 22*a* is higher in temperature than the side adjacent to the suction port 24*a* and, therefore, it has a larger expansion in through-thickness direction. On the other hand, the side adjacent to the suction port 24*a* of the peripheral wall 22*a* is lower in temperature than the side adjacent to the discharge port 24*b* and, therefore, it has a smaller expansion in through-thickness direction. At the ordinary temperature of the roots compressor 14, the clearance CL (a ratio of clearance) is gradually reduced from the side adjacent to the suction port 24*a* toward the side adjacent to the discharge port 24*b* , as shown by the graph G1 in FIG. 7. The resin layer J, when thermally expanded, has a uniform thickness all over in circumferential direction of the peripheral wall 22*a* . Therefore, if there is a difference in thermal expansion between the side adjacent to the suction port 24*a* and the side adjacent to the discharge port 24*b* of the peripheral wall 22*a*, the difference in thermal expansion of the peripheral wall 22*a* may be uniform by initial difference in clearance CL between the side adjacent to the suction port 24*a* and the side adjacent to the discharge port 24*b*.

As a result, as shown in the graph G2 of FIG. 7, if the resin layer J and the peripheral wall 22*a* thermally expand during operation of the roots compressor 14, the difference in clearance ratio will not significantly large between the side adjacent to the suction port 24*a* and the side adjacent to the discharge port 24*b*. In other words, the difference in clearance CL will be small between the side adjacent to the suction port 24*a* and the side adjacent to the discharge port 24*b*. It is noted that the clearance CL (a ratio of clearance) during operation of the roots compressor 14 may be approximated to zero by selection of the material of the peripheral wall 22*a*, adjustment of the thickness (a ratio of thickness) of the resin layer J, or the like, in accordance with the operating conditions of the roots compressor 14. Furthermore, the resin layer J thermally expands and, therefore, the clearance CL may be smaller than that at the ordinary temperature. Accordingly, the air leakage from the side adjacent to the discharge port 24*b* to the side adjacent to the suction port 24*a* through the clearance CL is reduced and the seal between the rotors 39, 40 and the resin layer J is prevented from being deteriorated.

According to the preferred embodiment, the following advantageous effects are obtained.

(1) The thickness of the resin layer J is gradually reduced from the side adjacent to the suction port 24*a* toward the side adjacent to the discharge port 24*b* in circumferential direction of the peripheral wall 22*a*. Therefore, if there occurs a difference in thermal expansion between the side adjacent to the suction port 24*a* and the side adjacent to the discharge port 24*b*, the thickness of the resin layer J after thermal expansion may be uniform all over in circumferential direction of the peripheral wall 22*a*. Accordingly, the difference in clearance CL between the side of the suction port 24*a* and the side of the discharge port 24*b* will be small. As a result, the seal between the rotors 39, 40 and the resin layer J is prevented from being deteriorated, and a decrease in compression ratio due to the air leakage from the side adjacent to the discharge port 24*b* to the side adjacent to the suction port 24*a*, an increase in drive power due to the air leakage and a direct slide between the rotors 39, 40 and the inner peripheral surface N of the peripheral wall 22*a* may be prevented.

(2) Particularly, the resin layer J thermally expands and, therefore, the clearance CL may be smaller than that at the ordinary temperature. Accordingly, the air leakage from the side adjacent to the discharge port 24*b* to the side adjacent to the suction port 24*a* may be reduced to the minimum.

(3) The distance L1, L2 between the inner peripheral surface N of the peripheral wall 22*a* and the drive and driven rotors 39, 40 are formed to be smaller from the side adjacent to the suction port 24*a* toward the side adjacent to the discharge port 24*b* in rotational direction. When the inner peripheral surface N is coated with the resin layer J, the clearance CL may be differentiated between the side adjacent to the suction port 24*a* and the side adjacent to the discharge port 24*b* of the peripheral wall 22*a*.

(4) The thickness of the resin layer J is steplessly reduced from the side of the suction port 24*a* toward the side of the discharge port 24*b*. Therefore, the clearance CL may be constantly uniform in comparison to the case where the thickness of the resin layer J is stepwise reduced and the positions of variation in thickness are stepped.

(5) The resin layer J is formed to be thinner from the side adjacent to the suction port 24*a* toward the side adjacent to the discharge port 24*b*. In comparison to the case where the resin layer J is formed to be uniform from the side adjacent to the suction port 24*a* toward the side adjacent to the discharge port 24*b*, the material cost of the resin layer J may be low.

The clearance CL is formed to be smaller from the side adjacent to the suction port 24*a* toward the side adjacent to the discharge port 24*b* in circumferential direction. Therefore, when the peripheral wall 22*a* thermally expands, the difference in expansion between the side adjacent to the discharge port 24*b* and the side adjacent to the suction port 24*a* may be evened by the difference in clearance CL therebetween. Accordingly, since the resin layer J is substantially uniform in thickness after thermal expansion, the clearance CL may be uniform in circumferential direction.

(7) The temperature of the peripheral wall 22*a* becomes proportionally higher from the side adjacent to the suction port 24*a* toward the side adjacent to the discharge port 24*b* during operation of the roots compressor 14, and the thickness of the resin layer J is proportionally thinner from the side adjacent to the suction port 24*a* toward the side adjacent to the discharge port 24*b* in accordance with the temperature gradient. Accordingly, the thickness of the resin layer J varies in accordance with variation in temperature distribution of the peripheral wall 22*a*, so that the thickness of the resin layer J, which thermally expands due to the temperature of the peripheral wall 22*a*, can be easily made uniform all over in circumferential direction.

(8) The resin layer J is formed as a layer. Therefore, coating the resin layer J on the inner peripheral surface N may be easy.

The present invention is not limited to the embodiment described above but may be modified into the following alternative embodiments.

In an alternative embodiment, the resin layer J is so formed that the thickness is uniform from the side adjacent to the suction port 24*a* toward the side adjacent to the discharge port 24*b* in circumferential direction and the clearance CL is smaller from the side adjacent to the suction port 24*a* toward the side adjacent to the discharge port 24*b* in circumferential direction. When the structure is thus formed, the difference in expansion of the peripheral wall 22*a* due to the temperature difference between the side adjacent to the discharge port 24*b* and the side adjacent to the suction port 24*a* is evened by the difference in clearance CL at the ordinary temperature of the roots compressor 14 during operation of the roots compressor 14. Then, during operation of the roots compressor 14, even if the temperature difference occurs between the side adjacent to the discharge port 24*b* and side adjacent to the suction port 24*a* and the difference in thickness thus occurs, the difference in clearance CL is reduced between the side adjacent to the discharge port 24*b* and the side adjacent to the suction port 24*a*. As a result, the seal between the rotors 39, 40 and the resin layer J is prevented from being deteriorated, and a decrease in compression ratio due to the air leakage from the side adjacent to the discharge port 24*b* to the side adjacent to the suction port 24*a*, an increase in drive power due to the air leakage and a direct slide between the rotors 39, 40 and the inner peripheral surface N of the peripheral wall 22*a* may be prevented.

In an alternative embodiment, the roots compressor 14 is used as the pump 17 in the hydrogen supply means 13 of the fuel cell system 10 for feeding fluid hydrogen. Furthermore, the roots compressor 14 is used as a compressor for compressing refrigerant of an air conditioner for feeding fluid refrigerant.

Figure 8:
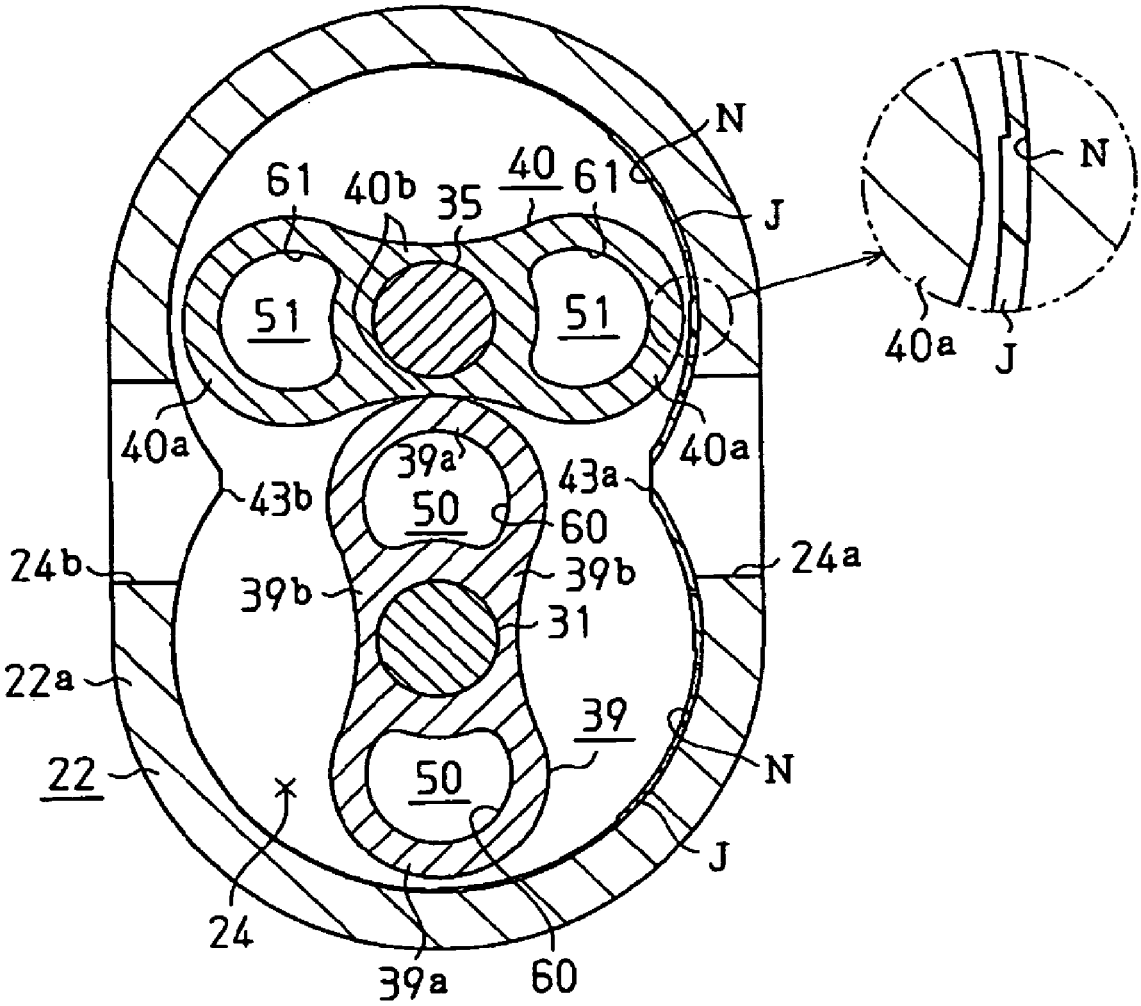
FIG. 8 is a cross-sectional view showing the inside of the pump chamber of a roots compressor according to an alternative embodiment of the present invention.

In an alternative embodiment as shown in FIG. 8, the thickness of the resin layer J is stepwise reduced from the side adjacent to the suction port 24*a* toward the side adjacent to the discharge port 24*b*.

In an alternative embodiment, the clearance CL at the ordinary temperature of the roots compressor 14 is set the same between the side adjacent to the suction port 24*a* and the side adjacent to the discharge port 24*b*. Specifically, the clearance CL may be uniform all over in circumferential direction of the peripheral wall 22*a*.

In an alternative embodiment, the front wall 22*b* and the shaft support member 23 are coated with the resin layer J.

In an alternative embodiment, the rotor housing 22 is formed into two halves including the side adjacent to the suction port 24*a* and the side adjacent to the discharge port 24*b*, the side adjacent to the suction port 24*a* is made of a material having a relatively higher coefficient of linear expansion, and the side adjacent to the discharge port 24*b* is made of a material having a relatively lower coefficient of linear expansion than the side adjacent to the suction port 24*a*. Then, the clearance CL is uniform in circumferential direction. In this case, in a state where the resin layer J thermally expands and the thickness is uniform as a whole, the side adjacent to the suction port 24*a* of the peripheral wall 22*a* thermally expands a little due to a low temperature despite its high coefficient of linear expansion, while the side adjacent to the discharge port 24*b* of the peripheral wall 22*a* thermally expands a little due to a low coefficient of linear expansion despite a high temperature. As a result, the clearance CL is uniform all over in circumferential direction. Alternatively, the rotor housing 22 is formed into a plurality of elements from the side adjacent to the suction port 24*a* toward the side adjacent to the discharge port 24*b*, the element of the side adjacent to the suction port 24*a* is made of a material having the highest coefficient of linear expansion, and is made of a material having a lower coefficient of linear expansion toward the side adjacent to the discharge port 24*b*.

In an alternative embodiment, the drive rotor 39 and the driven rotor 40 of the roots compressor 14 are trilobed.

In an alternative embodiment, plural pairs of the drive rotor 39 and the driven rotor 40 are mounted axially on the drive shaft 31 and the driven shaft 35, respectively, to form a multi-stage roots compressor.

Therefore, the present examples and embodiments are to be considered as illustrative and not restrictive, and the invention is not to be limited to the details given herein but may be modified within the scope of the appended claims.

What is claimed is:

1. A roots compressor comprising:

a housing defining a pump chamber, a suction port and a discharge port, wherein the suction port and the discharge port adjoin to the pump chamber;

a rotary shaft rotatably supported by the housing;

a rotor connected to the rotary shaft and contained in the pump chamber, wherein fluid introduced into the pump chamber through the suction port is discharged to the outside of the pump chamber through the discharge port by rotation of the rotor which is driven through the rotary shaft; and a layer formed on an inner peripheral surface of the housing, which defines the pump chamber, wherein the layer near the discharge port is thinner than the layer near the suction port in circumferential direction of the housing when the compressor is at ordinary temperature.

2. The roots compressor according to claim 1, wherein the layer is steplessly formed.

3. The roots compressor according to claim 1, wherein the layer is stepwise formed.

4. The roots compressor according to claim 1, wherein the layer and the rotor define therebetween a clearance, which is narrower from the side adjacent to the suction port toward the side adjacent to the discharge port in the circumferential direction.

5. The roots compressor according to claim 1, wherein the temperature of the housing is proportionally higher from the side adjacent to the suction port toward the side adjacent to the discharge port in the circumferential direction during operation of the compressor, and wherein the layer is proportionally thinner from the side adjacent to the suction port toward the side adjacent to the discharge port in the circumferential direction.

6. The roots compressor according to claim 1, wherein the layer is made of resin.

7. The roots compressor according to claim 6, wherein the resin has a high coefficient of linear expansion.

8. The roots compressor according to claim 7, wherein the resin includes ethylene-tetrafluoroethylene copolymer resin.

9. The roots compressor according to claim 1, wherein the roots compressor is used for compressing oxygen supplied to a fuel cell system.

10. The roots compressor according to claim 1, wherein a distance between a rotation center of the rotary shaft and the inner peripheral surface of the housing is gradually reduced from the side adjacent to the suction port toward the side adjacent to the discharge port in rotating direction of the rotor.

11. The roots compressor according to claim 1, wherein the rotor is offset from a center of a circular arc of the inner peripheral surface.

* * * * *